United States Patent [19]

Schwarzkopf

[11] Patent Number: 4,682,547

[45] Date of Patent: Jul. 28, 1987

[54] AMUSEMENT RIDE WITH VEHICLES SUPPORTED BY UNIVERSALLY HINGED WHEEL GROUPS

[75] Inventor: Anton Schwarzkopf, Münsterhausen, Fed. Rep. of Germany

[73] Assignees: Firma Schwarzkopf GmbH, Munsterhausen, Fed. Rep. of Germany; Intamin Corporation, Vaduz, Liechtenstein

[21] Appl. No.: 667,472

[22] PCT Filed: Jan. 31, 1984

[86] PCT No.: PCT/EP84/00021

§ 371 Date: Oct. 1, 1984

§ 102(e) Date: Oct. 1, 1984

[87] PCT Pub. No.: WO84/03052

PCT Pub. Date: Aug. 16, 1984

Related U.S. Application Data

[63] Continuation-in-part of Ser. No. 507,898, Jun. 24, 1983, Pat. No. 4,520,732.

[30] Foreign Application Priority Data

Feb. 1, 1983 [DE] Fed. Rep. of Germany ..... 3303279

[51] Int. Cl.[4] ..... B61B 3/00; B61F 5/38

[52] U.S. Cl. ..... 104/53; 104/95; 104/109; 104/63; 104/246; 105/154; 105/199.2

[58] Field of Search ..... 104/53, 89, 63, 64, 104/67, 95, 245, 246, 106, 107, 109, 118, 120; 105/148, 154, 193, 199 A, 199.2; 238/134; 188/302, 303, 304; 267/70, 72, 153

[56] References Cited

U.S. PATENT DOCUMENTS

| | | | |
|---|---|---|---|
| 555,921 | 3/1896 | Boyle | 104/107 X |
| 640,050 | 12/1899 | von Thal et al. | 104/89 X |
| 687,370 | 11/1901 | Douglass | 105/155 X |
| 779,896 | 1/1905 | Wood, Jr. | 285/405 X |
| 1,470,931 | 10/1923 | Perkins | 188/302 |
| 1,796,619 | 3/1931 | Phare | 104/53 X |
| 2,474,471 | 3/1949 | Dolan, II | 105/199 A X |
| 2,642,005 | 6/1953 | Cooper | 104/63 |
| 3,081,711 | 3/1963 | Davino | 104/95 |
| 3,090,326 | 5/1963 | Goodell et al. | 104/107 X |
| 3,457,876 | 7/1969 | Holden | 104/89 |
| 3,720,172 | 3/1973 | Dehne | 104/89 X |
| 3,941,060 | 3/1976 | Morsbach | 104/63 X |
| 4,270,748 | 6/1981 | Ray | 104/69 X |

FOREIGN PATENT DOCUMENTS

| | | | |
|---|---|---|---|
| 0628704 | 10/1961 | Canada | 105/148 |
| 2306385 | 8/1974 | Fed. Rep. of Germany . | |
| 2329423 | 1/1975 | Fed. Rep. of Germany | 104/89 |
| 2639826 | 3/1978 | Fed. Rep. of Germany | 104/120 |
| 0649181 | 2/1928 | France | 104/63 |
| 0728401 | 4/1955 | United Kingdom | 188/88 |

*Primary Examiner*—Robert B. Reeves
*Assistant Examiner*—Scott H. Werny
*Attorney, Agent, or Firm*—Karl F. Ross; Herbert Dubno

[57] ABSTRACT

An amusement ride installation of a closed track figure eight configuration has passenger carriers suspended to swing from a plurality of support rods pivotally mounted to a single carriage. Each carriage has a frame made of transverse and longitudinal members with a lower longitudinal member having a raised middle part wherein the vehicle suspending support rods are pivotally mounted. U-shaped yokes affixed to the frame with universal joints, hold at least two wheel groups, which comprise running rollers and guide rollers riding on rails. Also connected to the frame are V-shaped struts which support drive spars having brake flanges, and damping cylinders which damp oscillations of the pivoting support rods using a toothed rack assembly. Elastic couplings are provided to connect adjacent carriages.

12 Claims, 13 Drawing Figures

1
2
3
4
5
6
7
8
9
10
11
40
II
VII 5
6
9
10
11

AMUSEMENT RIDE WITH VEHICLES SUPPORTED BY UNIVERSALLY HINGED WHEEL GROUPS

CROSS REFERENCE TO RELATED APPLICATIONS

This application is a national phase application corresponding to PCT/EP84/00021 filed Jan. 31, 1984 and based upon German national application 33 03 279.3 of Feb. 1, 1983. It is also a continuation-in-part of U.S. application Ser. No. 06/507,898 filed June 24, 1983, issued as U.S. Pat. No. 4,520,732 on June 4, 1985.

FIELD OF THE INVENTION

The invention relates to an amusement ride with a figure-eight track configuration having passenger cars movable in a suspended state along a closed-track system. The cars are swingably suspended, via support rods, from carriages provided with running- and guide rollers and are braced against the carriages by means of a damping arrangement.

BACKGROUND OF THE INVENTION

Compared to figure-eight tracks of the common configuration, amusement-park businesses can expect an increase in the attraction of the ride combined with a cost-advantageous construction, with improvements in such rides. Up to now, however, the course of the development has not led to an installation capable of operating in an unobjectionable manner.

In the amusement ride proposed in German Patent 861 369 with gondolas in the shape of airplanes swingably suspended from a track, there was still no concept regarding the construction of the track system and the chassis. To the contrary, German open application 23 06 385 puts forward a basic concept wherein two vertical support arms are stationarily mounted to the passenger carrier and swingably suspended over running rollers and guide rollers, each to one carriage. Here the running rollers are guided in channels which are disposed opposite to one another and are rigidly connected. Between these channels the chassis is provided with a ball-and-socket joint for the swingable suspension of the support arms for the passenger carriers. Over curved stretches the channels are inclined correspondingly to the expected centrifugal force. Lateral forces are supposed to be absorbed by spring-equipped guide rollers. In this system the fact that suspended passenger cars can be subjected to pendulously swinging motions even when the curved tracks were inclined, was ignored.

On traveling over a curve, the suddenly acting centrifugal force causes the pasenger car to swing outwardly past the equilibrium position and then again, to swing back past the original vertical position. The passenger car also swings around the equilibrium position. Upon leaving the curve, the passenger car can continue to swing, and resonances can result. The safety of the passenger cannot be guaranteed.

German Patent 23 29 423 attempts to relieve this problem in the case of a similarly known amusement ride by proposing that in a rigid carriage the lateral guide wheels be rigidly guided and the running wheels be journaled via a rocker. The tracks, consisting of four tubes, are always disposed horizontally, even on curved stretches. The thereby increased pendulous oscillations are absorbed by friction damping members, the damping action thereof being proportional to the angular offset of the passenger car. These friction-damping elements are telescopically mounted between an almost vertical support rod holding the passenger car and the carriage pivotally mounted in such a way as to describe a smaller radius than that of their pivot point on the support rod. The forces acting upon the pivot point on the carriage generate a torque in the latter which causes the undercarriage to press against the rails with two of the guide wheels on one side. Also the running wheels are pressed against the upper rails, which can lead to the undesired braking of the running wheels.

In practice, this known arrangement does not avoid the feared pendulous swinging, but rather increase the susceptibility to breakage of the parts of the carriage and even of the supporting structure of the passenger car.

OBJECT OF THE INVENTION

It is the object of the invention to provide an amusement ride of the described type, wherein the pendulous oscillations transverse to the riding direction can be effectively reduced or avoided, without exposing parts of the construction to stresses which can lead to breakage.

SUMMARY OF THE INVENTION

According to the invention, each carriage has a stable carriage frame, which absorbs all of the centrifugal and damping forces originating from the pasenger car and transmits them distributively to the rail over a plurality of pin-jointed carriage groups. Thereby a branching of the forces and a balancing of the forces takes place; consequently structural parts of the carriage and of the supporting structure are no longer subjected to break-producing stresses.

Due to a swivel connection with the frame the carriage groups can independently adjust to each curve position or finishing irregularities of the rail, without being thereby negatively influenced by transverse centrifugal- and damping forces.

A separation of the ball-and-socket joint from the support rods and the carriage groups leads to substantially reduced joint stress and permits the use of simpler and more stress resistant joints instead of the ball-and-socket joint according to German open application 23 29 423. Within the individual carriage groups for achieving the required three-dimensional freedom of rotation, two separate joints in the form of a universal joint and a single joint for the roller carrier can also be provided.

In order to achieve an optimum result in the distribution and the balancing of forces the invention provides a pair of rocker arms, which are swingably pivoted in the cross member and slidably connected with the carriage yokes. Only the vertical component of the forces acting from the passenger carrier upon the carriage yokes is thereby transmitted and only half of it is distributed to each carriage yoke. This way the guide- and running rollers are evenly pressed with their running surfaces against the rail. Reciprocally, the swinging motions of one yoke around the ride-direction axis over the rocking arms leads to an opposite swinging motion of the other yoke.

Thus the irregularities of the rails are compensated and the uniform bearing pressure of all rollers is preserved even when riding segments of tortuous rails with twisted running surfaces corresponding to the centrifugal force.

Besides the different application points of the damping arrangement, the invention also provides other damping elements than the German open application 23 29 423.

While, in the mentioned state of the art, part of the oscillation energy must be annihilated by generating friction effect, in the system of the invention, due to the use of pneumatic cushions a considerable damping of the oscillation energy is brought about.

The invention provides for an even more effective damping via hydraulic- or pneumatic damping cylinders which can be accommodated in an extremely space-saving way in correspondingly built carriage frames. The alternate actuation of these cylinders through a toothed rack which changes an oscillatory motion of the support rod into a straight translatory motion makes possible a damping with an optimal characteristic curve, which means a damping force increasing overproportionally with the angle of oscillation.

The damping works optimally when it follows a motion with only one directional component. For this purpose the invention provides that each passenger carrier be individually suspended from a single carriage. Thereby the main joint needs only one degree or rotational freedom, which can be converted into a unidirectionally shifting motion via the pairing of a gear and toothed rack according to the invention. At the extremities of the toothed rack, guide rollers are provided, which, when in contact with the guide rails cause a resetting motion of the extended toothed rack. Thereby it is possible for instance in boarding stations to align the passenger carriers centrally and to lock them in this position.

The combination of several passenger carriers to form a train can be performed in various ways, for instance the connection of the individual carriages is achieved via a coupling rod which allows a coupling of the neighboring carriages with three degrees of rotational freedom. Also, the limitedly extendable coupling rod acts as a shock absorber, because it elastically absorbs the traction-pressure shocks.

In addition, the invention departs from the concept to provide tubes in the track system as means for guiding the running- and guide rollers. Moreover, it has been proven that it is better to guide the rollers in rails correspondingly inclined and twisted in the curved stretches, in order to take the load from the entire width of the individual rollers, Of course, the teaching of German open application 23 06 385 with the U-rail described therein is not suitable for the application of this concept.

The rail construction of the invention is particularly applicable to amusement rides of different construction types. The bracing tube advantageously has a cylindrical cross section which provides the required strength to the rail structure and offers the possibility of mounting the rail structure suspended from the crossbeams of the steel structure of the amusement ride. Such a tube is bendable with a necessary special device, so that the theoretically predetermined rail path can be followed surprisingly accurately. The running- and guide rails welded to this bracing tube have the required even surfaces adapted to curves. All together, cost-advantageous and very accurately performing rail construction results that is especially suited for passenger carriers guided in a suspended state.

Finally, the invention departs from the previously known concept to let drag drives work on the chassis for moving the passenger carriers on uphill stretches. Instead, the invention proposes a new design of the passenger carrier for suspended arrangements whereby said carriers have at their bottom a downwardly open, continuous canal for mounting entrainment elements for engaging the dragging equipment. Due to the construction of the carriage according to the invention, no coercion occurs in this arrangement, although the dragging equipment engages the passenger carrier at a considerable distance from the carriage.

In a variant thereto the invention proposes in another embodiment the arrangement of the drive spars in the upper area of the carriage. The drive takes place in this case on provided rubber rollers. This has the advantage that the passengers are far away from the danger area of the drive. For the same reason, the braking bars are mounted high over the heads of the passengers on the drive spars. The braking bars have recesses in which locking elements engage in the case of a current failure, in order to prevent a back-rolling of the ascending carriage.

BRIEF DESCRIPTION OF THE DRAWING

Details of the invention are schematically shown in the drawing. The drawing shows.

SPECIFIC DESCRIPTION

Figure 1:
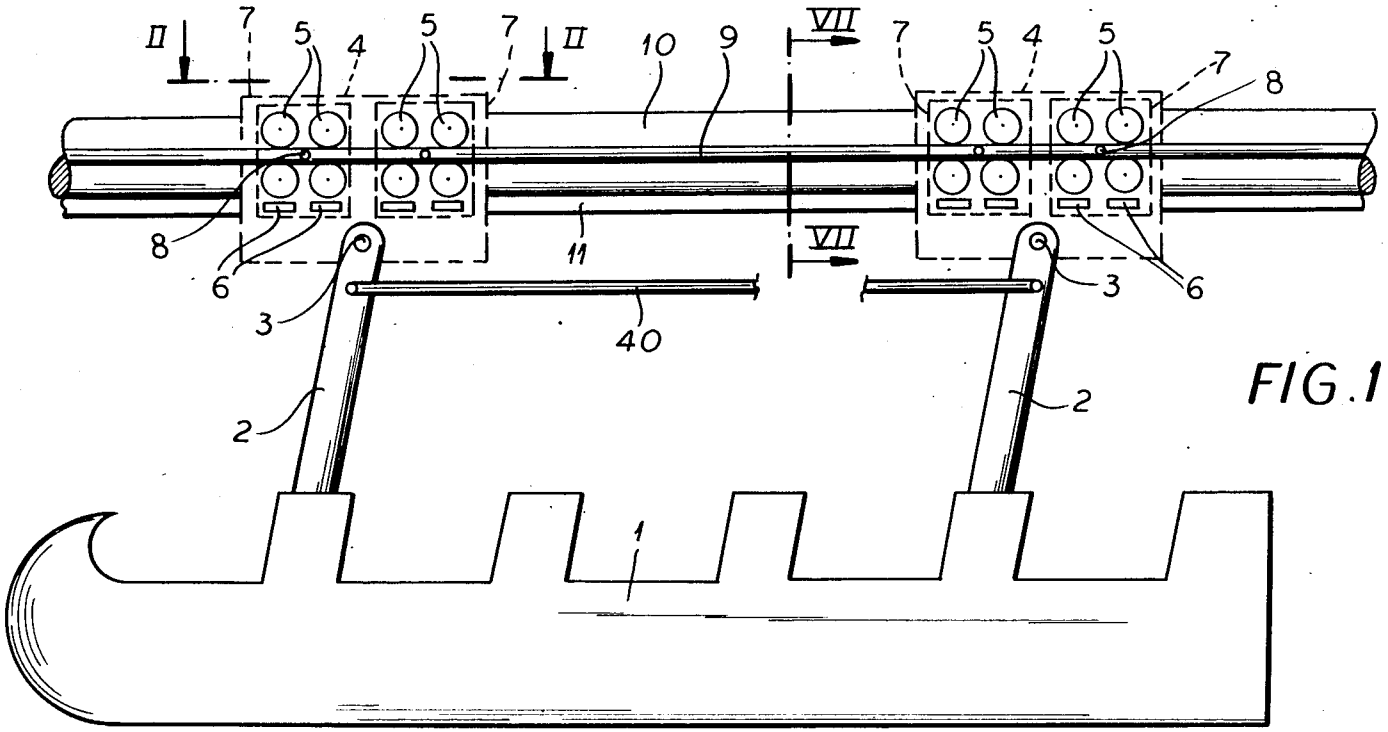
FIG. 1: a passenger carrier guided along a rail in a suspended state, in a conceptual side elevation.

FIG. 1. schematically shows a passenger carrier 1 mounted swingably suspended to a carriage 4 over support rods 2 rigidly attached to the carrier, said carriage being guided along a rail structure 9, 10, 11. This rail structure 9, 10, 11 is part of a closed-track system of the figure-eight type which has uphill and downhill stretches and curves with rapidly changing inclination, none of which are visible, whereby the installation is laid out to overcome high elevational differences and thereby to produce high riding speeds with correspondingly high centrifugal forces.

The individual passenger carrier 1 is swingably suspended from the carriage 4 by means of a main joint 3. Each support rod 2 is associated with its own carriage 4.

The support rods 2 can be connected to each other through a bar 40 as known to the state of the art.

Figure 3:
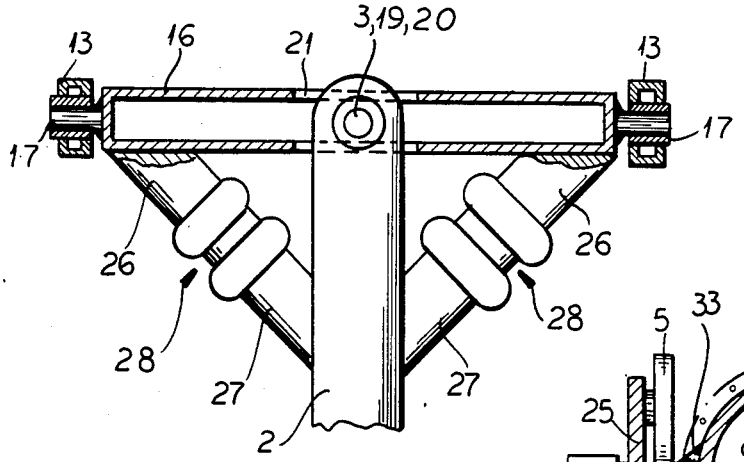

When riding curves a considerable centrifugal force acts upon the passenger carrier 1 and its support rods 2, which could create the feared pendulous swingings. The way the invention deals with the damping of these oscillations is shown in FIG. 3, to which we will revert later.

Figure 7:
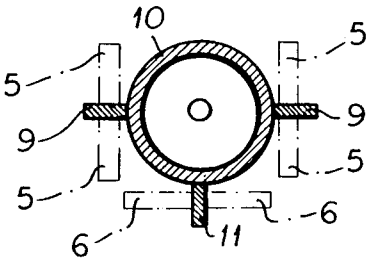

The individual carriage 4 is divided according to the embodiment of FIG. 1 in several carriage groups 7, each of said carriage groups 7 having four pairs of running rollers 5 and two pairs of guide rollers 6 which as shown in FIG. 7 work on running rails 9 and guiding rails 11 having a rectangular cross section and which are welded to a tubularly shaped rail carrier 10. In the curved stretches these rails 9, 11 are inclined correspondingly to the expected centrifugal force, whereby they follow the position of the rail carrier 10 bent according to the theoretical axis of the rails.

The problem of the invention consists only in keeping the running- and guide rollers 5, 6 freely adjustable, in spite of the constantly changing rail guidance and in distributing as even as possible to all the rollers 5, 6 the forces resulting from the pendular motion of the passenger carrier 1 and the damping of said forces, in order to avoid breakage-causing stresses. For this purpose, the individual carriage group 7 is articulately suspended from the carriage 4, whereby a link is symbolically represented at 8, whose axis is transverse to the axis of the rail and thereby extended towards the ride direction 37. Further linkage axes are clearer represented in FIG. 2 which shows the carriage 4 in one of its constructive embodiments, in a top view.

Figure 2:
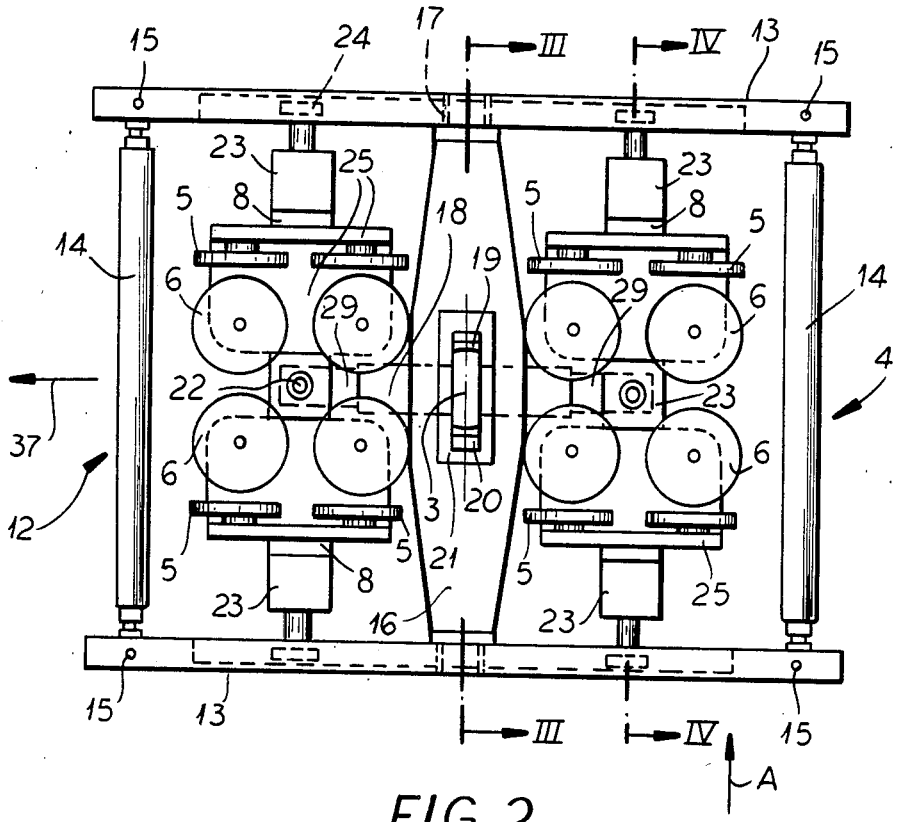
FIG. 2: a top view of a carriage according to section II—II in FIG. 1, FIG. 3: a partial cross section through the carriage along the line III—III in FIG. 2, FIG. 4: a cross section through the carriage according to line IV—IV in FIG. 2, FIG. 5: a side view of the carriage according to arrow A in FIG. 2, FIG. 6: a front view of a passenger carrier according to FIG. 1, FIG. 7: a cross section through the rail structure along the line VII—VII in FIG. 1, FIG. 8: a side view of a train of coupled, modified carriages.

The carriage 4 according in FIG. 2 comprises first of all a carriage frame 12, consisting of a longitudinal member 18 and a crossbar 16. The crossbar 16 built as a hollow box is mounted in the middle of the carriage 4 and connected over the bearing 17 with the rotatable rocker arms 13. The rocker arms 13 are mounted longitudinally to the ride direction 37 and connected over the joint 15 with the transverse spar 14 so that the rocker arms 13 and the transverse spar 14 can to a certain extent perform movements relative to each other, as a result of the existing forces.

The swivel bearings 17 are advantageously built as sleeve bearings and have an axial play so that a displacement of the linkage frame comprising the rocker arms 13 and the transverse spars 14 does not lead to hindrances.

The crossbar 16 is rigidly connected with the longitudinal member 18. The longitudinal member 18 is located in the vertical plane running through the rail axis and is provided at its ends with flattened spigots 29, wherein the universal joints 22 with vertical rotational axes are located. The function of the universal joint 22 is best seen from FIG. 4 to be described later, wherein directional indications, such as "vertical" or "horizontal" refer to the carriage 4 respectively passenger carrier 1 suspended in rest position from the rail structure 9, 10, 11.

On the longitudinal member 18 in the crossbar 16 the main linkage 3 (compare FIG. 1) is mounted consisting of a swing bearing 19 which receives the bearing eye 20 of the support rod 2. In order to maintain the free mobility of the eye 20 respectively the support rod 2 in the top and bottom walls of the crossbar 16 correspondingly shaped openings 21 are provided. The support rod 2 can therefore oscillate around the axis formed by the longitudinal member 18 transverse to the ride direction 37. The thereby generated pendulous oscillations are damped by means of the arrangement 41 according to FIG. 3 and the therefrom resulting counterforces act upon the crossbar 16 as torsional moments around the axis of the longitudinal member 18.

As already shown in FIG. 1, groups of running rollers 5 and guiding wheels 6 are assembled and as such articulately suspended from the carriage 4. According to FIG. 2 the rollers 5,6 are supported in roller carriers 25 (see also FIG. 4) which are suspended to the yokes 23 rotatably around the joint axis 8 already shown in FIG. 1, said yokes surrounding in a U-shaped manner two roller carriers 25 opposite to each other with their rollers 5,6 (compare FIG. 4), rotatably journaled in the universal joint 22 and movably guided in the rocker arms 13 with the aid of rollers 24. The individual carriage group 7 consists therefore of a yoke 23 with two roller carriers 25 as well as the running- and guide rollers 5, 6 and possesses, through the linkages 8, 22, three degrees of rotational freedom.

When the carriage 4 is in a curved stretch, the yokes 23 can rotate around the vertical joint axis 22 and position themselves in a sharp angle relative to each other. This relative swivelling is not obstructed by the guidance of the rollers 24 in the rocking arms 13, since these rocking arms 13 are advantageously constructed as a U-profile open towards the inside, wherein the rollers 14 can perform circular movements around the joints 22 at the inner surfaces of the wings of said U-profile.

The universal joints 22 are constructed as swing bearings 30 (see FIG. 4), so that the yokes 23 can also position themselves independently around the axis of ride direction 37, when passing through the reversing points of the curved stretches. As a result the inclination of the curve in the area of the reversing points cannot create hindrances for the rollers 5, 6 or their carriers.

In extreme cases the carriage group 7 is able to assume an erratically askew position in various directions, compared to the position shown in FIG. 2.

In FIG. 3 the crossbar 16 is represented in the partial section III—III recognizable from FIG. 2. On the support rod 2 as well as on the crossbar 16 strut-like members 26, 27 are provided, between them the pneumatic springs 28 constructed as bellow cylinders are inserted. These air springs are construction parts known from the chassis techniques for heavy trucks and railroad vehicles. The pendulous oscillation around the axis 3, 19, 20 leads to the deformation of the air springs 28 due to compression or decompression of the air contained therein, whereby considerable damping and generation of restoring forces can result. To the air springs 28 valves (not shown) are connected, leading to the sources of compressed air and meant to maintain the theoretically pre-established air pressure in the air springs 28.

The number of air springs is determined according to the prevailing load. Their bellows are to be mounted in such a way as to insure their deformation and consequently their damping effect even in the case of diagonal oscillations of the support rods 2. If it is desired to completely or partially annihilate the restoring forces, it is recommendable to connect pressurewise the inner space of the air springs located opposite to each other on both sides of the support rod 2.

The damping of the pendulous oscillations of the support rod 2 around the axis 3, 19, 20 by means of the air springs 28 leads to the torque of the crossbar 16 around the mentioned axis 3, 19, 20. This torsional moment is transmitted to the rocker arms 13 via the bearing 17 and due to the articulated arrangement of the carriage group 7 in the rocker arm 13 is carried on to the running- and guide rollers 5, 6. Since these rollers 5, 6 run their entire width along the rails 9, 11 they able to absorb the distributed forces and to avoid breakage.

Figure 4:
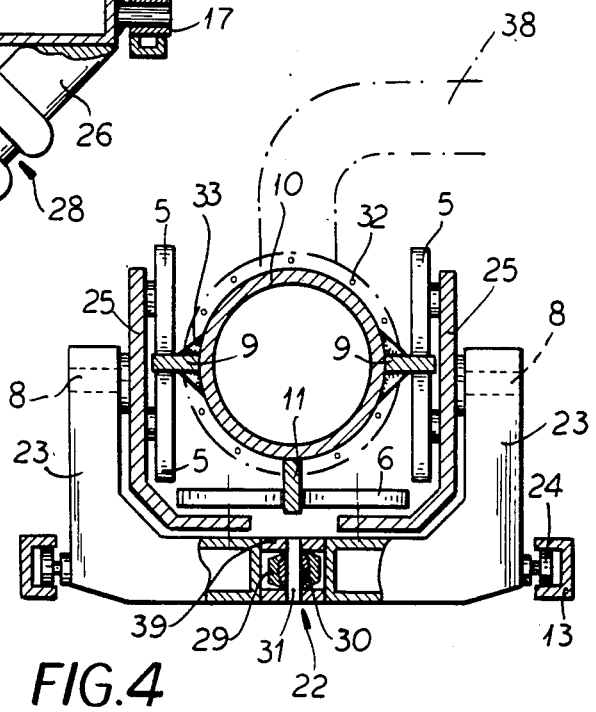

It can be seen from FIG. 4 the way the longitudinal member 18 with its flattened spigot 29 is guided between the webs 39 spaced apart from each other of a yoke 23. A pivot pin 31 is mounted in these webs 39. The spigot 29 mounted to crown them and with play between the flanges 39 is led on the pivot pin 31 over a swing bearing 30. Thereby, the yoke 23 can perform an oscillating motion around the axis of the pivot pin 31 (joint 22). Also, the longitudinal member 18 is capable, with the aid of the swing bearing 30, to rotate around its axis in spite of the pivot pin 31. The other yoke 23 does not have to be provided with this swing bearing when the longitudinal bar 18 is rotatably journaled in the crossbar 16.

It is shown in FIG. 4 that the running- and guide rails 9, 11 are stiffened against the rail carrier 10 by means of gusset plates 33. The running surfaces for the running rollers 5 and guide rollers 6 are located laterally with respect to the gusset plates 33. Several sections of the rail carriers 10 are connected to each other via flange 32. The diameter of this flange 32 is also dimensioned so that the running surfaces of the rails 9, 11 are not impaired. A supporting arm 38, symbolically shown in dotted lines, for instance engages in the area of impact of the rail carrier 10 and is connected to a structure not shown. This creates the possibility of mounting the rail structure suspended from the steel structure, without negatively influencing the rollers 5, 6 of the chassis 4.

Figure 5:
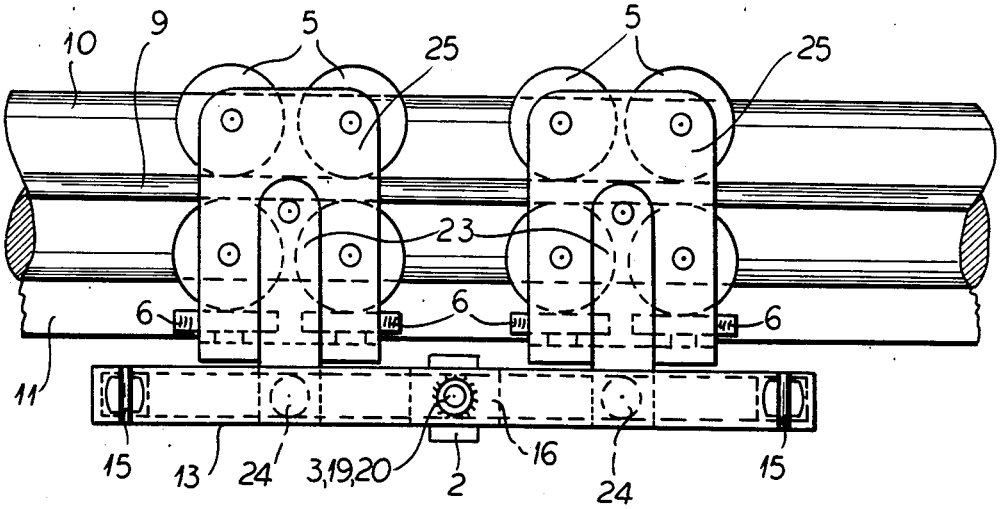

In the side view according to FIG. 5 the position of the joint 8 is clarified, whereby the roller carrier 25 carrying the running- and guide rollers 5, 6 is swingable around said joint. In spite of the rectilinear representation of the running rails 9 selected in FIG. 5, it is noticeable that the running- and guide rollers 5, 6 can adjust their position easily to the concave or convex bends of the running rail 9, because the roller carrier 25 can swing around the joint axis 8.

Figure 6:
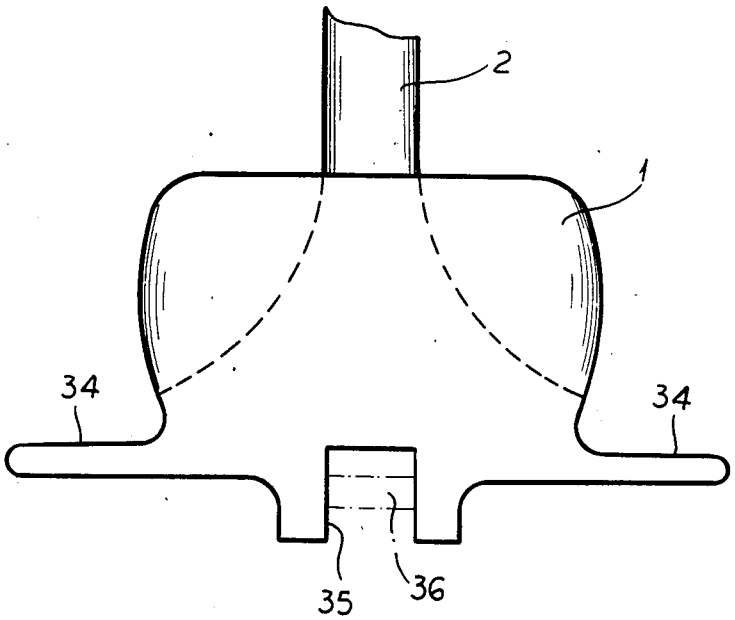

In the example of FIG. 6 it is finally shown that the individual passenger carrier 1 has at its bottom a canal 35 running continuously in the direction of the ride and open downwardly, in which entrainment elements 36, shown symbolically in dotted lines, can be mounted, said elements being designed for the engagement by dragging devices. In the common type of amusement rides with figure-eight track configuration, the passenger carrier 1 is moved by such (not represented) dragging devices along an uphill stretch, up to the highest point of the steel structure and from there passenger carrier 1 returns due to its own energy, over downhill, uphill and curved stretches to its departure point. In the case of suspended passenger carriers 1 it was common practice up to now to have the dragging device engage the carriage. Since the carriage 4 according to the invention is constructed flexibly, the possibility was created to have the dragging device act upon the passenger carrier 1 at a point far away from the carriage 4 and also the possibility to keep the required brake installation at a distance from the carriage. Footboards for facilitating the boarding of the passenger carrier 1 are marked 34.

Figure 8:
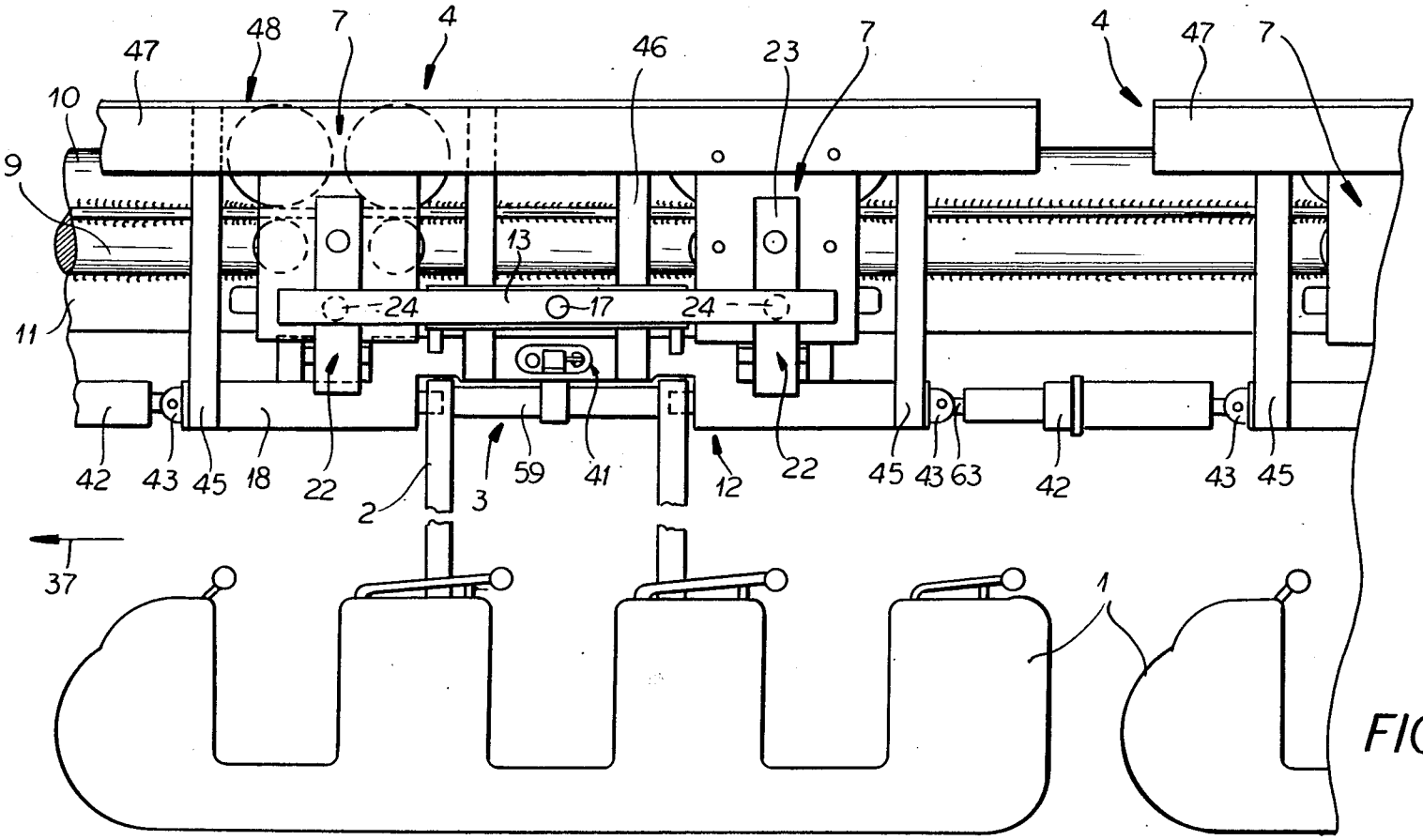
Figure 13:
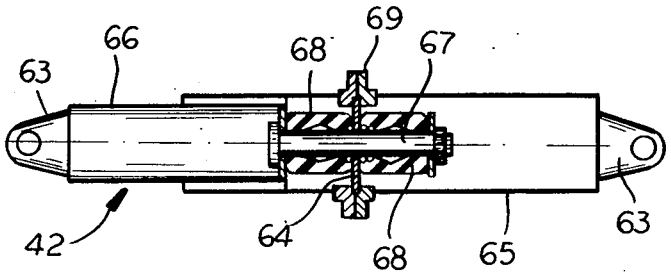

FIG. 8 show sectionally a train of several passenger carriers 1. In a modified embodiment of the FIG. 1, here the passenger carrier 1 is suspended from a single carriage 4. In order to assemble a train in this embodiment the carriages 4 are connected to each other via coupling rods 42, whereby at the beginning and the end of the train the coupling rods are replaced by rubber buffers. This type of train connection can also be used in the embodiment of FIG. 1, where one passenger carrier 1 is suspended from two carriages 4. Besides, the train connection can also be arranged so that the neighboring support rods of two passenger carriers are suspended together from a common carriage.

In FIGS. 8 to 12 a second embodiment of the carriage 4 is represented. In this case each passenger carrier 1 is suspended from a single carriage 4. The suspension is achieved via a support rod system, which this time consists of two individual support rods 2 connected to each other via a shaft 59, running along the direction of the ride 37. Contrary to the embodiment of FIGS. 1 to 5 this main joint 3 has only one degree of rotational freedom around the axis of the ride direction 37.

Figure 9:
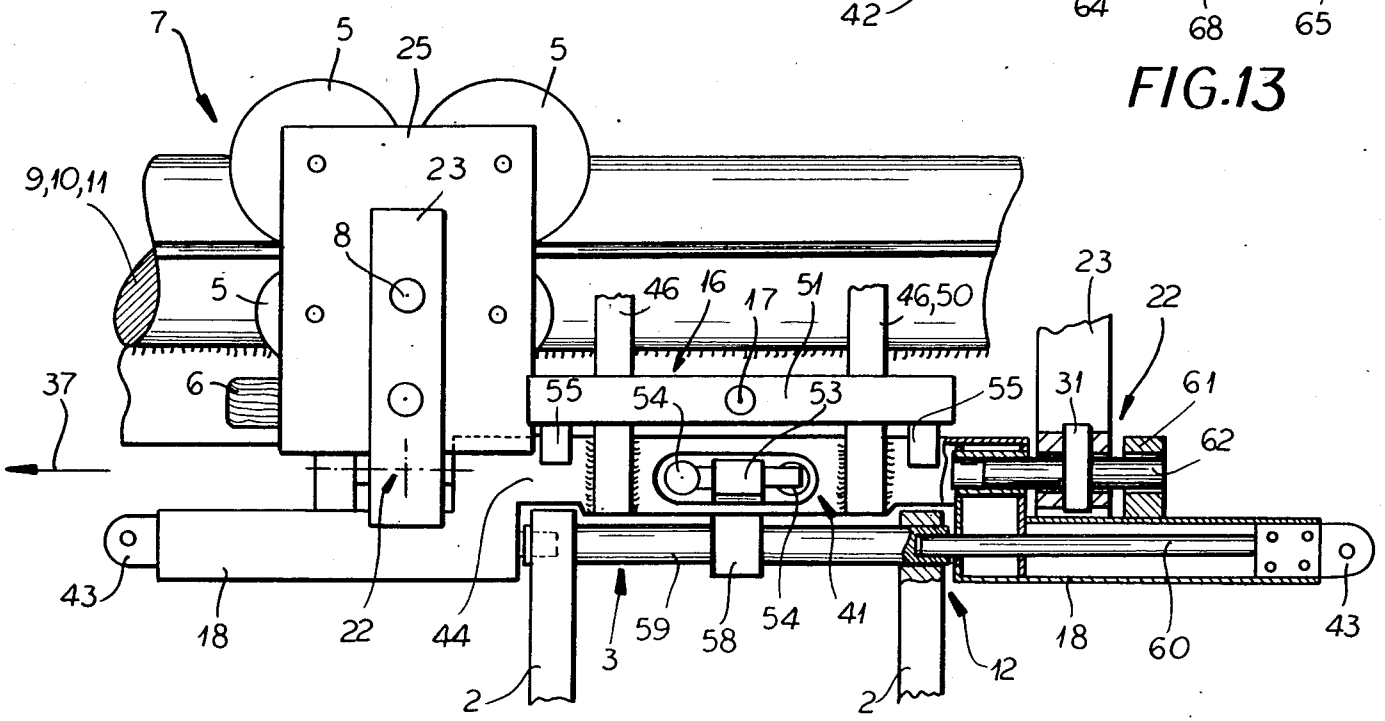
FIG. 9: an amplified, partially sectioned side view of a carriage according to FIG. 8, FIG. 10: a partially sectioned top view of a carriage according to FIG. 9, FIG. 11: a frontal view of a half section through the carriage along line XI—XI of FIG. 10, FIG. 12: a sectioned frontal view of a carriage according to line XII—XII of FIG. 10, and FIG. 13: a cross section through a coupling rod.

As shown by FIGS. 8 and 9, the longitudinal member 18 is constructed as a bridge and has a raised middle part 44, below which the main joint 3 is mounted. The longitudinal member 18 is built for example as a welded box, having at each of its support ends an axle 60 engaging into the bores of the shaft 59, respectively of the support rods 2 so that a swing bearing is created. In order to mount or to demount the main joint 3, the axles 60 are detachably connected with the longitudinal beam 18 over connecting flanges. For an improved guidance of the support rods 2 the middle part 44 of the support has slanted recesses.

Figure 10:
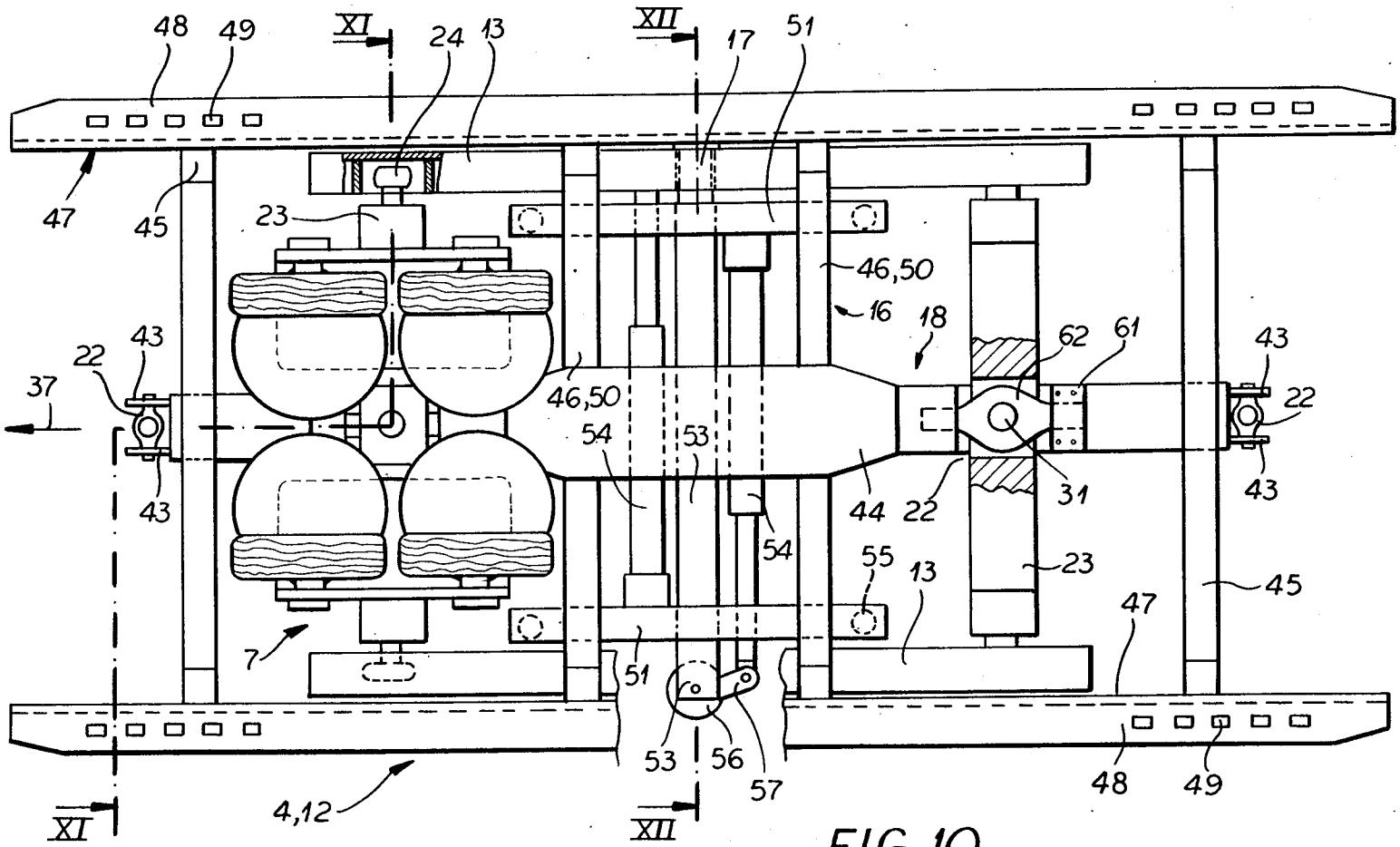
Figure 11:
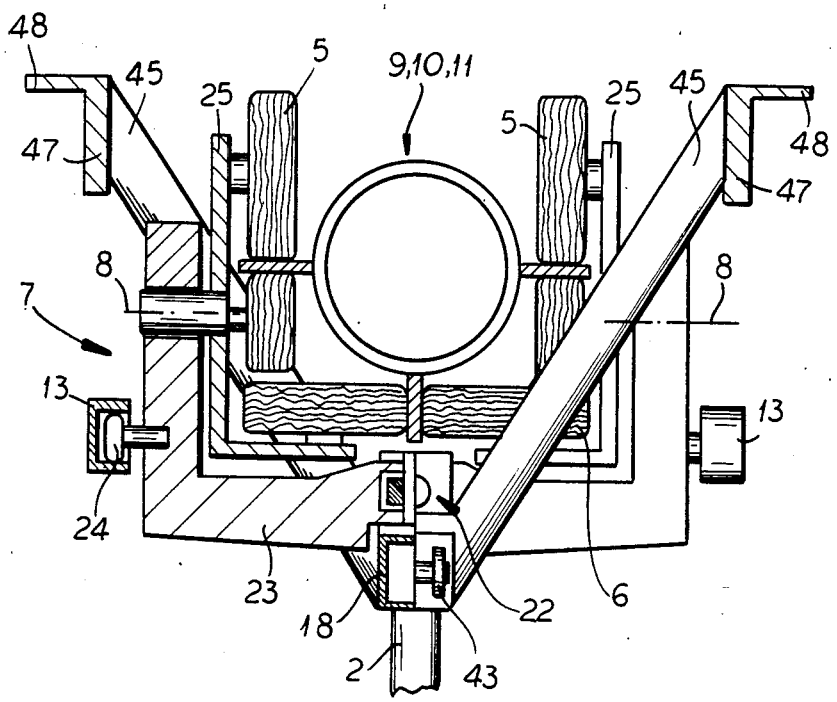

The carriage groups 7 correspond essentially to those of FIGS. 1 to 5. The difference consists though in the construction of the two universal joints 22. The universal joints 22 consist each of a shaft plate 62 in which a pivot pin 31 is rotatably guided. The shaft plates 62 are rotatably journaled in the middle part 44 of the support, each in a pillow block 61 and rotate around the ride direction axis 37, in their middle section they have a romboidal, rounded, thicker portion. The pivot pin 31 is fastened in the middle of the crossbar of the yoke 23. As shown in FIGS. 9 and 10, the yokes 23 have a passage opening for the shaft plates 62, through which opening the latter are guided with lateral play (compare to FIG. 10) but in the vertical they are guided only with form-closing slight play (compare to FIG. 9). This way the yoke 23 can rotate with respect to the longitudinal member 18 and the shaft plate 62 around its vertical axis, whereby the shaft plate 62 with its thicker portion offers a sufficiently broad carrying surface to meet the forces.

Similar to the embodiments of FIGS. 1 to 5, the yokes 23 are guided over rollers 24 each in a rocker arm 13 extending longitudinally in the ride direction 37. In this embodiment the rollers 24 have spherically rounded running surfaces or are constructed directly like ball pins with slide rings which are guided in the rocker arms 13 so as to be longitudinally displaceable.

The rocker arms 13 are this time, by eliminating the transverse spar, swingably journaled in the crossbar 16 via combined radial- and axial bearing 17. The functions of the carriage groups 7, the rocker arms 13 and the carriage frame 12 are thereby basically the same as in the first embodiment. The carriage groups 7 are able to adjust freely to the position of the rail and thereby influence each other over the rocker arms 13 for achieving a balanced roller pressure. Conversely the centrifugal and damping forces originating from the passenger carrier 1 are transmitted via the crossbar 16 to the rocker arms 13 and from there in equal parts to the carriage groups 7.

In comparison with the first embodiment, the construction of the carriage 12 and the damping arrangement 41 are changed. The longitudinal beam 18 and crossbar 16 are rigidly connected to each other in the shape of a cross with arms of equal length, however the crossbar 16 is built like a frame. The crossbar 16 consists here of two support beams 51 mounted with a spacing parallel to the longitudinal members 18, said support beams being fastened to the widened middle portion of the support via two pairs of struts 46, 50 (compare to FIG. 10).

Within the cross-bar 16 there is sufficient room for the damping arrangement 41. This consists of a toothed rack 53 and two oscillation dampers 54 built of pneumatic or hydraulic damping cylinders, which pass through an opening in the middle portion 44 of the support widened for this purpose and which are journaled, respectively guided (see FIG. 12) on the outside on the guiding flanges 52 located at the bottom of the support beam 51. The toothed rack 53 is guided in the support middle portion 44 and in guide flanges 52 transversally displaceable with respect to the ride direction 37. On the shaft 59 of the main joint 3, in the middle, a ring gear 58 is provided, which protrudes through a corresponding opening in the bottom of the support middle portion 44 and meshes with the toothed rack 53.

When the passenger carrier 1 swings outwardly, the ring gear 58 with the support rods 2 respectively the shaft 59 rotates along and displaces the toothed rack 53 corresponding to the angle of oscillation. The oscillation dampers 54 are mounted on both sides of the toothed rack 53 and parellely thereto, but with extension directions opposite to each other. Each piston of the damping cylinders 54 is connected via an entraining flange 57 with one end of the toothed rack 53. When due to outward swinging of the passenger carrier 1 the toothed rack is displaced in whatever direction, the pistons of the damping cyliners 54 are entrained, whereby one piston is pushed in and the other one is pulled out. Corresponding to this actuation, the damping cylinders 54 are preferably built as one-way dampers. But, it is also entirely possible to use two-way dampers, just as well as the transformation of the rotatory motion of the gear ring into a translatory motion of the toothed rack makes possible the arrangement of other types of damping means. The damping cylinders 54 are supported on the support beams 51 and on the support middle portion 44, while their pistons are displaceably guided in the guide flanges 52.

At each extremity of the toothed rack 53 a horizontally protruding guide roller 56 is pivoted, said roller in cooperation with the corresponding rigidly fastened guide rails causes a restoring movement and a fixation of the toothed rack 53 and thereby of the passenger carrier 1.

Figure 12:
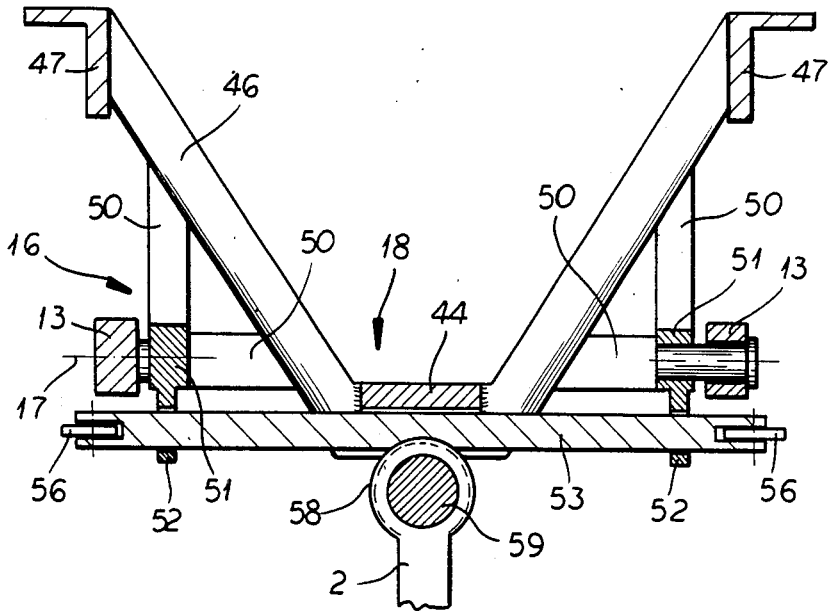

As shown in FIGS. 8 and 10 to 12, each carriage 4 has in its upper area two longitudinally running drive spars 47 which are fastened to the longitudinal member 18 via the V-shaped struts 45, 46. As shown in FIG. 12, vertical and horizontal struts 50 project from V-struts 46 to which the support beams 51 of the crossbar 16 are fastened. On the drive spars 47, outwardly projecting flange-like brake spars 48 are fastened, continuously or in segments, said brake spars having recesses 49 for the engagement with emergency locking catches. The drive spars 47 and the brake spars 48 are braced against the chassis frame 12 via the V-struts 45, 46 to the point where the drive- and braking forces can not cause any twisting of the carriage 4.

The longitudinal members 18 have coupling flanges 43 at their ends, which preferably are fastened to the flanges of the axles 60. The first and last chassis of the train can have rubber buffers instead of the flanges 43. The coupling flanges 43 can be connected with the coupling flanges 63 of the coupling rod 42 via the universal joints 22 of the afore-described kind. This way the connection has two degrees of rotational freedom.

The coupling rod 42 consists of two hollow cylinders 65, 66 inserted into each other, mutually retractable or extensible. A rod 67 is mounted at the inside of the hollow cylinder 66 on which a washer 64 is fitted between two rubber paddings 68. The rubber paddings 68 are affixed to the rod 67 on both sides, by the washers and a shaft nut. The outer hollow cylinder 65 is divided transversally, whereby the two sections are bolted to each other on the outside over the guide flange 69. When the guiding flange 69 is bolted, an annular slot results at the inside, in which the disk 64 is guided in a form-closing manner in axial direction but can turn around the longitudinal axis with respect to the outer hollow cylinder 65. Therefore, the washer 64 together with the two rubber paddings 68 create an elastic connection between the two hollow cylinders 65, 66, whereby the coupling rod 42 can be extended or retracted within certain limits. In order to increase the compressibility, the rubber paddings 68 are provided with recesses on their inner surface pressed against the rod 67.

The embodiment of the carriage 4 represented in FIGS. 8 to 12 makes possible oscillation angles of the support rods 2, respectively the passenger carrier 1 of about 90° from the neutral position. This is possible due to the raised support middle portion 44 and the even higher positioned support beams 51 of the crossbar. In order to limit the angle of the outward swinging, rubber buffers 55 are provided underneath the support beams 51, the supporting rods 2 coming to rest against said buffers.

I claim:

1. An amusement ride comprising:

rail means defining a closed travel path;

a plurality of carriages provided with running rollers and guide rollers riding on said rail means, each of said carriages comprising:

a respective carriage frame formed with longitudinal members running generally in a direction of travel of the carriage along said rail means, and transverse members extending transversely to said longitudinal members and connected thereto, said longitudinal members including at least one lower longitudinal member of a bridge configuration with a raised middle part, and at least two wheel groups spaced apart along and affixed to the respective carriage frame and each provided with a common support and with respective sets of said running rollers and said guide rollers journaled on the respective support and riding on said rail means;

a respective passenger carrying vehicle connected to each of said carriages whereby each carriage is individual to one of said passenger carrying vehicle and each of said passenger carrying vehicles is carried by only one of said carriages;

a respective plurality of support rods suspending each of said passenger carrying vehicles from a respective one of said carriages;

articulation means including a shaft rotatable about a respective axis extending in said direction, and positioned below each said raised middle part for pivotally supporting at least a pair of said rods for swinging movement about the respective said axis extending in said direction, each of said pairs of rods being connected to said shaft; and damping means including at least one linearly effective oscillation damper mounted on said frame, and means for transforming rotation of said shaft into linear displacement of said damper for damping oscillation of said vehicle about the respective said axis.

2. The amusement ride defined in claim 1 wherein said damping means includes a pinion on said shaft, a rack mounted on said raised middle part for movement transversely to said direction and meshing with said pinion, and said linearly effective oscillation damper comprises a pair of generally parallel piston-and-cylinder oscillation dampers operatively coupled to said rack and mounted in said frame and extending generally transversely tp said direction for damping oscillation of each said vehicle about the respective said axis.

3. The amusement ride defined in claim 2 wherein each of said supports includes a yoke and respective universal joints articulating respective lower ends of each yoke to said lower member of the respective carriage adjacent the respective raised middle part thereof.

4. The amusement ride defined in claim 2 wherein each of said supports includes a yoke having lower ends, each of said lower ends being formed with an articulation roller having a horizontal axis transverse to said direction, a respective rocker arm being pivotally connected to a respective one of said transverse members fixed to said lower member at said raised middle part thereof for swinging movement of the respective rocker arm about an axis transverse to said direction, each of said rocker arms being formed with a channel open towards said yokes and receiving said respective articulation rollers thereof.

5. The amusement ride defined in claim 2 wherein the frame of each carriage has two longitudinally extending drive spars lying outwardly of said supports at an upper part of the respective frame and forming further ones of said longitudinal member, and struts in a V pattern spaced along the respective carriage and connecting said drive spars with said lower longitudinal member of the respective carriage.

6. The amusement ride defined in claim 5 wherein each of said drive spars has an outwardly extending brake flange provided with spaced apart recesses therealong.

7. The amusement ride defined in claim 2, further comprising means including at least one coupling elastically yieldable in said direction for connecting each of said carriages to a following carriage at the respective said lower members of the respective frames while enabling the lower members of frames connected by each coupling to rotate relatively about an axis generally extending in said direction.

8. An amusement ride comprising:

rail means defining a closed travel path;

a plurality of carriages provided with running rollers and guide rollers riding on said rail means, each of said carriages comprising:

a respective carriage frame formed with longitudinal members running generally in a direction of travel of the carriage along said rail means, and transverse members extending transversely to said longitudinal members and connected thereto, said longitudinal members including at least one lower longitudinal member of a bridge configuration with a raised middle part, at least two wheel groups spaced apart along and affixed to the respective carriage frame and each provided with a common support and with respective sets of said running rollers and said guide rollers journaled on the respective support and riding on said rail means, the frame of each carriage having two longitudinally extending drive spars lying outwardly of said supports at an upper part of the respective frame and forming further ones of said longitudinal members, and struts in a V pattern spaced along the respective carriage and connecting said drive spars with said lower longitudinal member of the respective carriage;

a respective passenger carrying vehicle connected to each of said carriages whereby each carriage is individual to one of said passenger carrying vehicle and each of said passenger carrying vehicles is carried by only one of said carriages;

a respective plurality of support rods suspending each of said passenger carrying vehicles from a respective one of said carriages;

articulation means below each said raised middle part for pivotally supporting at least a pair of said rods for swinging movement about a respective axis extending in said direction; and damping means between said rods and said frame for damping oscillation of said vehicle about the respective said axis.

9. The amusement ride defined in claim 8 wherein each of said drive spars has an outwardly extending brake flange provided with spaced apart recesses therealong.

10. An amusement ride comprising:

rail means defining a closed travel path;

a plurality of carriages provided with running rollers and guide rollers riding on said rail means, each of said carriages comprising:

a respective carriage frame formed with longitudinal members running generally in a direction of travel of the carriage along said rail means, and transverse members extending transversely to said longitudinal members and connected thereto, said longitudinal members including at least one lower longitudinal member of a bridge configuration with a raised middle part, and at least two wheel groups spaced apart along and affixed to the respective carriage frame and each provided with a common support and with respective sets of said running rollers and said guide rollers journaled on the respective support and riding on said rail means;

a respective passenger carrying vehicle connected to each of said carriages whereby each carriage is individual to one of said passenger carrying vehicle and each of said passenger carrying vehicles is carried by only one of said carriages;

a respective plurality of support rods suspending each of said passenger carrying vehicles from a respective one of said carriages;

articulation means below each said raised middle part for pivotally supporting at least a pair of said rods for swinging movement about a respective axis extending in said direction;

damping means between said rods and said frame for damping oscillation of said vehicle about the respective said axis; and means including at least one coupling elastically yieldable in said direction for connecting each of said carriages to a following carriage at the respective said lower members of the respective frames while enabling the lower members of frames connected by each coupling to rotate relatively about an axis generally extending in said direction.

11. The amusement ride defined in claim 10 wherein said coupling includes a coupling rod connected by universal joints to said lower members of the frames connected thereby.

12. The amusement ride defined in claim 10 wherein said coupling rod has two rotatable and and shiftable telescoping hollow cylinders which are elastically connected to each other in said direction.

* * * * *